US006012862A

United States Patent [19]

Nakano et al.

[11] Patent Number: 6,012,862

[45] Date of Patent: Jan. 11, 2000

[54] INK-JET PRINTING APPARATUS HAVING PAPER FEED STRUCTURE AND CONTROL

[75] Inventors: Masashi Nakano; Naoyuki Izumi, both of Niigata, Japan

[73] Assignee: NEC Corporation, Japan

[21] Appl. No.: 09/069,624

[22] Filed: Apr. 29, 1998

[30] Foreign Application Priority Data

May 1, 1997 [JP] Japan ..... 9-113811

[51] Int. Cl.[7] ..... B41J 13/16

[52] U.S. Cl. ..... 400/625; 400/628

[58] Field of Search ..... 400/622, 624, 400/625, 628, 636.1, 638, 639.1, 642, 645; 271/213

[56] References Cited

U.S. PATENT DOCUMENTS

| | | | |
|---|---|---|---|
| 4,794,859 | 1/1989 | Huseby et al. . | |
| 5,890,821 | 4/1999 | Lesniak et al. | 400/625 |
| 5,927,877 | 7/1999 | Kelly et al. | 400/625 |

FOREIGN PATENT DOCUMENTS

| | | |
|---|---|---|
| 52-3317 | 6/1950 | Japan . |
| 1145153 | 7/1989 | Japan . |
| 3293138 | 12/1991 | Japan . |
| 4255354 | 9/1992 | Japan . |
| 4308150 | 10/1992 | Japan . |
| 8-198495 | 8/1996 | Japan . |

*Primary Examiner*—John Hilten

*Attorney, Agent, or Firm*—Ostrolenk, Faber, Gerb & Soffen, LLP

[57] ABSTRACT

An ink-jet printing apparatus permits sequential ejection of printed papers without causing stain by non-dried ink, improves printing quality and permits down-sizing of the overall apparatus by simplifying a construction of a paper ejecting mechanism. An ink-jet printing apparatus includes a paper ejecting roller rotatable in a first direction for ejecting said printing medium and a second direction opposite to said first direction and an arm member arranged between said paper ejecting roller and said ejected paper stacker and movable between a first position projecting above said ejected paper stacker for supporting said printing medium from a lower side thereof, and a second position retracted from the position above said ejected paper stacker and permitting falling down of said printing medium. The ink-jet printing apparatus further includes motion force transmitting means for transmitting rotation of said paper ejecting roller in said first direction.

12 Claims, 9 Drawing Sheets

INK-JET PRINTING APPARATUS HAVING PAPER FEED STRUCTURE AND CONTROL

BACKGROUND OF THE INVENTION

1. Field of the Invention

The present invention relates generally to an ink-jet printing apparatus for a printer, facsimile, copy machine and so forth. More particularly, the invention relates to an ink-jet printing apparatus which can stack ejected printing media in sequential order of ejection.

2. Description of the Related Art

Among ink-jet printers, there are some printers of the type sequentially stacking printing papers ejected after printing on an ejected paper stacker. In this type of the ink-jet printer, the ejected paper is stacked on the already stacked immediately preceding printing paper with grazing the printed surface of the latter. Therefore, an ink on the preceding printing paper is not yet dried, the printed surface of the preceding printed paper and the back surface of the currently ejected paper are stained by the ink.

An ink-jet printer which can improve the problem set forth above, has been disclosed in Japanese Unexamined Patent Publication No. Heisei 1-145153, for example. FIG. 9 is a sectional front elevation of a paper ejecting mechanism of the ink-jet printer disclosed in the above-identified publication. The paper ejecting mechanism has a pair of rail members 26*a* and 26*b* opposing to each other and extending in parallel in an ejecting direction of a printing paper 27 on an ejected paper stacker 25. The rail members 26*a* and 26*b* pivoted in directions to approach the tip ends thereof with each other and located at an ejected paper receiving position as shown by a solid line in FIG. 9. The rail members 26*a* and 26*b* are pivotable in directions to move the tip ends away from each other to be placed at a paper releasing position as shown by a two dotted line in FIG. 9.

In the conventional ink-jet printer constructed as set forth above, a driving force of a motor is transmitted to the rail members 26*a* and 26*b* via a platen support body to pivotally driving the rail members 26*a* and 26*b* between the ejected paper receiving position and the paper releasing position. In order to achieve this, a complicate construction becomes necessary. On the other hand, the rail members 26*a* and 26*b* are required sufficient length in order to support the overall length from the front end to the rear end of the edge portion of the printing paper 27. This can be a hazard for down-sizing of the paper ejecting mechanism.

SUMMARY OF THE INVENTION

The present invention has been worked out in order to solve the problems set forth above. Therefore, it is an object of the present invention to provide an ink-jet printing apparatus which permits sequential ejection of printed papers without causing stain by non-dried ink, improves printing quality and permits down-sizing of the overall apparatus by simplifying a construction of a paper ejecting mechanism.

According to one aspect of the present invention, an ink-jet printing apparatus of a type, in which sheet form printing media ejected in substantially horizontal direction are stacked on an ejected paper stacker in sequential order of ejection, comprises:

a paper ejecting roller rotatable in a first direction for ejecting said printing medium and a second direction opposite to said first direction;

movable member arranged between said paper ejecting roller and said ejected paper stacker and movable between a first position projecting above said ejected paper stacker for supporting said printing medium from a lower side thereof, and a second position retracted from the position above said ejected paper stacker and permitting falling down of said printing medium;

motion force transmitting means for transmitting rotation of said paper ejecting roller in said first direction as a motion force for moving said movable member toward said first position and transmitting rotation of said paper ejecting roller in said second direction as a motion force for retracting said movable member toward said second position; and control means for driving said paper ejecting roller in said first direction in advance of ejection of said printing medium for projecting said movable member to said first position via said motion force transmitting means and driving said paper ejecting roller in said second direction for retracting said movable member in said second direction.

In the ink-jet printing apparatus according to the present invention, since the movable member is projected above the ejected paper stacker by rotation of the paper ejecting roller in advance of ejection of the printing medium, the ejected printing medium is once supported partly from the lower side by the movable member, and transferred in the condition supported from the lower side. Therefore, the printing medium is ejected without contacting with the printing medium ejected to the ejected paper stacker at preceding timing. Subsequently, since the movable member is retracted to the second position by rotation of the paper ejecting roller, the printing paper is released from the movable member to fall down. By this, the subsequent printing medium can be stacked after elapsing of period for drying of the ink so that the stain by the ink may not be caused in the sequentially ejected printing medium. On the other hand, the rotation force of the paper ejecting roller can be used as motion force of the movable member to require no separate driving power source, to simplify the paper ejecting mechanism. Furthermore, if the movable member has the shape capable of supporting a part of the printing medium from the lower side, the supporting function of the printing medium can be realized. Therefore, the elongated shape, such as the rail member in the conventional paper ejecting mechanism becomes unnecessary to permit down-sizing of the paper ejecting mechanism.

The ink-jet printing apparatus may further comprise restricting means for restricting further movement of said movable member when said movable member is reached at said first position or said second position, and lost motion means for causing lost motion rotation of said paper ejecting roller relative to said movable member from the timing where said movable member reaches said first position or said second position. By this, with maintaining rotation of the paper ejecting roller, the movable member can be stopped at the first position or the second position to simplify a control sequence.

In further preferred construction, the control means projecting said movable member at said first position by again rotating said paper ejecting roller in said first direction without transporting said printing medium after once driving said paper ejecting roller in said second direction and subsequently retracting said movable member to said second position by rotating said ejecting roller in said second direction. In this case, the printing medium not fallen down as partly contacting with the paper ejecting roller, can be forcedly fallen down.

Preferably, the movable member may be constructed with an arm member having a rack slidably supported in an ejecting direction of said printing medium and extending in said ejecting direction. In this case, by arranging the pinion rotating together with the paper ejecting roller, the motion force can be easily transmitted to the movable member.

On the other hand, the motion force transmitting means may comprise a pinion meshing with said rack, and a frictional driven roll contacting with a driving roll integrally fixed on a rotary shaft of said paper ejecting roller, and said lost motion means comprises said driving roll and said frictional driven roll. In this case, the mechanism for moving the movable member by rotation of the paper ejecting roller can be realized by simply construction.

BRIEF DESCRIPTION OF THE DRAWINGS

The present invention will be understood more fully from the detailed description given herebelow and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessarily obscure the present invention.

Figure 1:
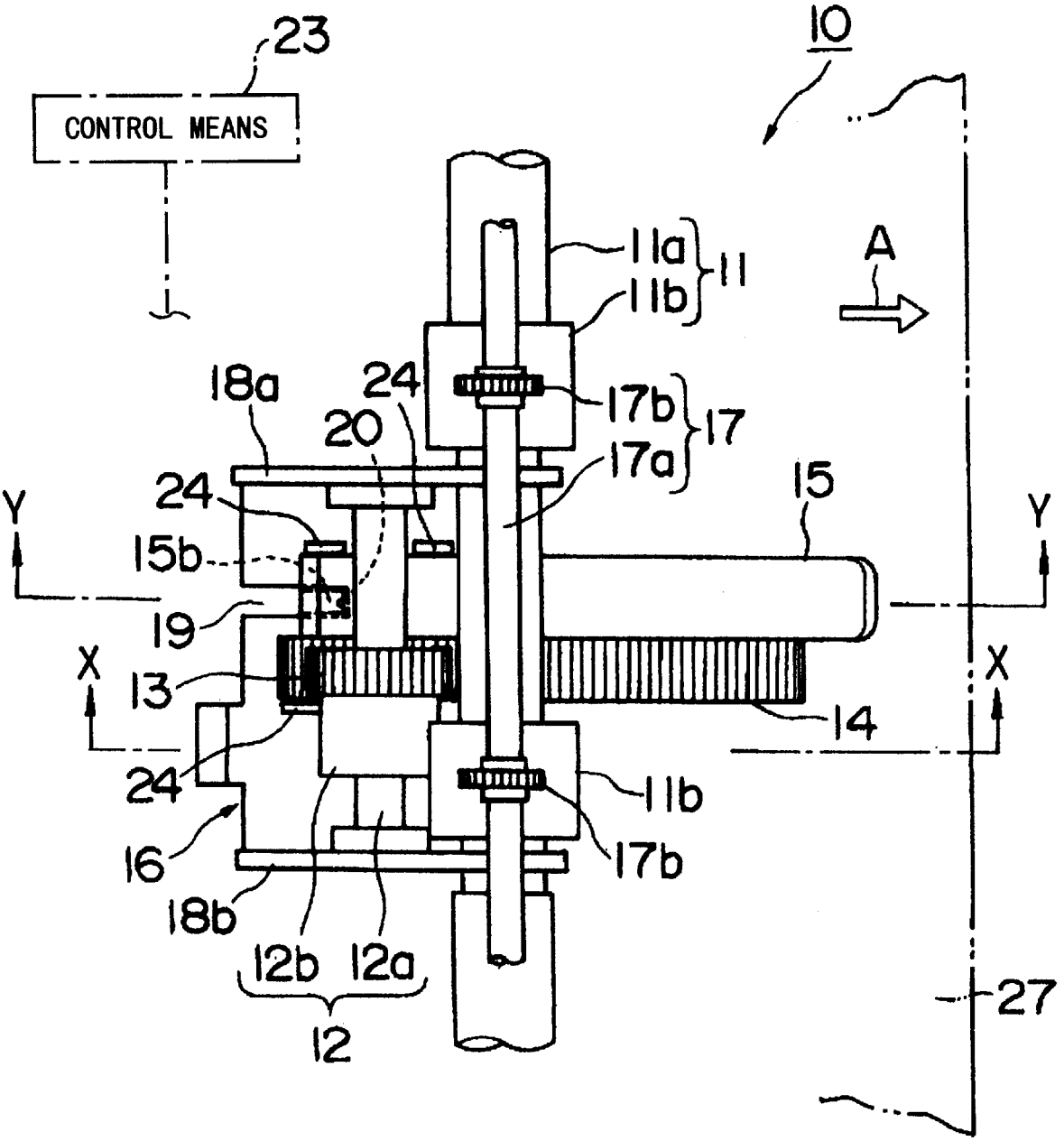
FIG. 1 is a plan view showing one embodiment of a paper ejecting mechanism of an ink-jet printer according to the present invention.
Figure 2:
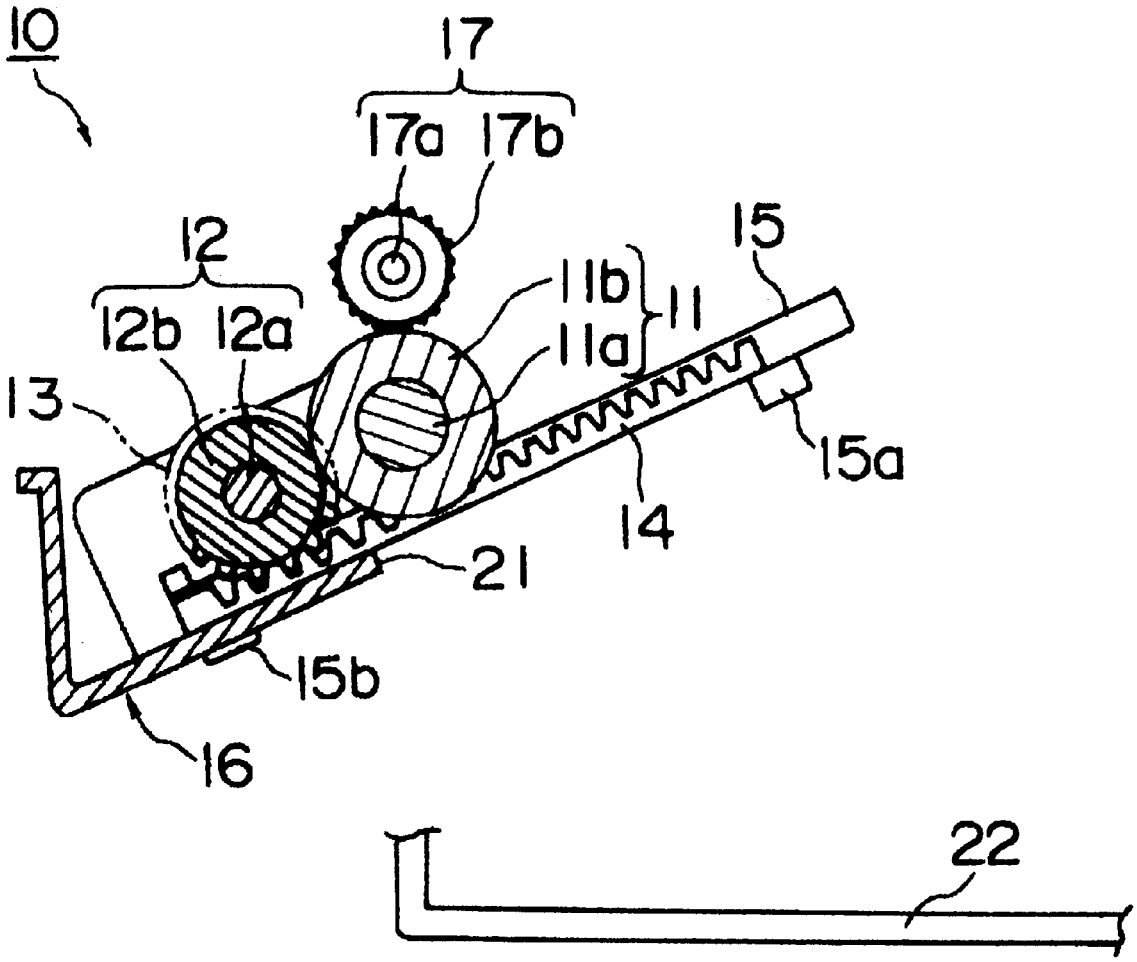
FIG. 2 is a section taken along line X—X of FIG. 1.
Figure 3:
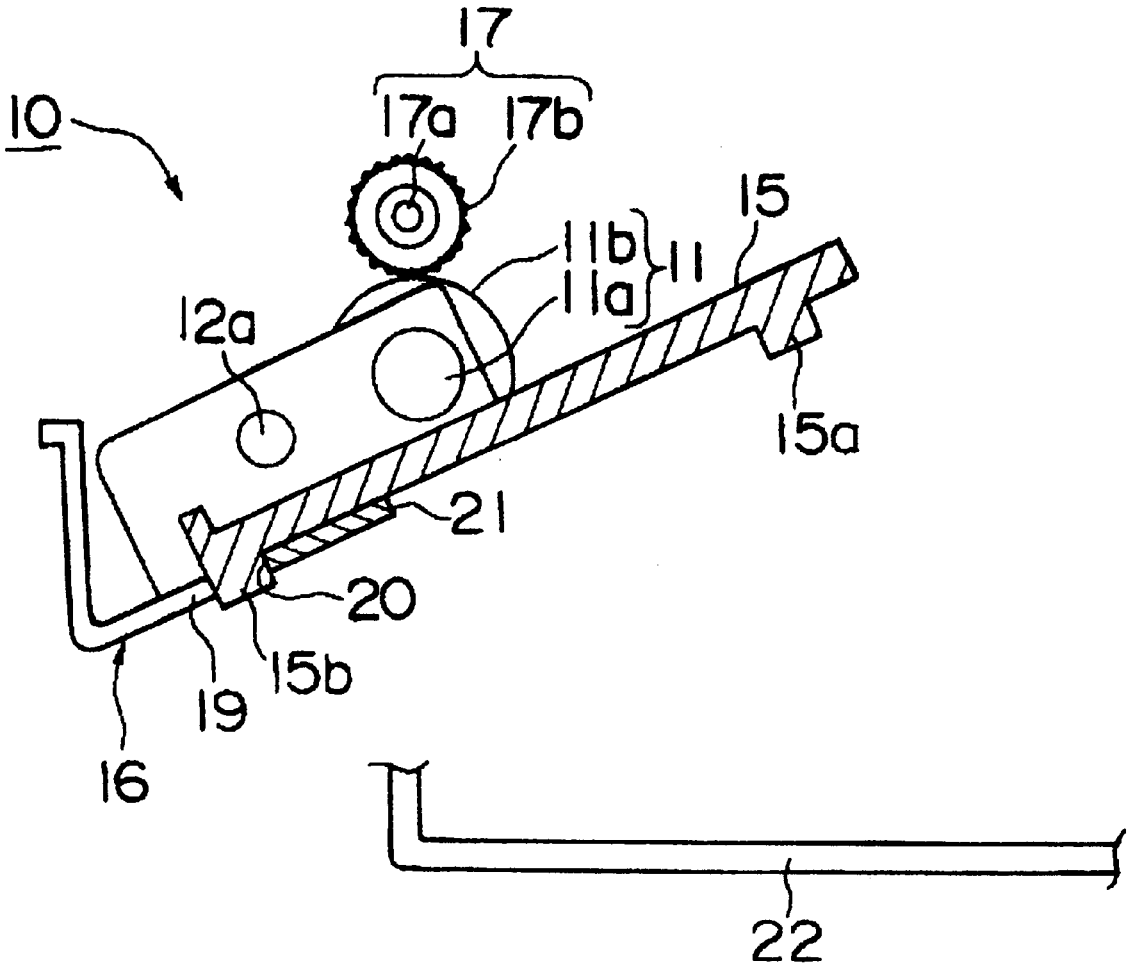
FIG. 3 is a section taken along line Y—Y of FIG. 1.

FIG. 1 is a plan view showing one embodiment of an ink-jet printer (ink-jet printing apparatus) according to the present invention, FIG. 2 is a section taken along line X—X of FIG. 1, and FIG. 3 is a section taken along line Y—Y of FIG. 1.

The shown embodiment of an ink-jet printer is designed for sequentially stacking printing papers (printing media) 27 ejected in substantially horizontal direction from ejection opening (not shown) on an ejected paper stacker 22. An paper ejection mechanism 10 has a support frame 16 fixed in the vicinity of an upper portion of the ejected paper stacker 22. The support frame 16 is arranged to be placed at a center portion in the width direction of the printing paper 27 transported in an ejecting direction A, and has supporting walls 18*a* and 18*b* extending substantially in parallel in an ejecting direction A and opposing to each other. On the supporting walls 18*a* and 18*b*, a paper ejecting roller 11 and a transmission roller 12 are respectively supported in an orientation substantially perpendicular to the ejecting direction A. The paper ejecting roller 11 receives rotation of a not shown motor to drive rotation in a clockwise direction (first direction) for ejecting the printing paper 27 and a counter-clockwise direction (second direction).

The paper ejecting roller 11 includes a rotary shaft 11*a* rotatably supported on the supporting walls 18*a* and 18*b*, a plurality of rolls (driving rolls) having greater diameters than that of the rotary shaft 11*a* and supported on the rotary shaft 11*a* for rotation with maintaining integrity therewith. The transmission roller 12 includes a rotary shaft 12*a* located adjacent the rotary shaft 11*a* and rotatably supported on the supporting walls 18*a* and 18*b*, and a roll (frictionally driven roll) 12*b* having greater diameter than that of the rotary shaft 12*a* and supported on the rotary shaft 12*a* for rotation with maintaining integrity therewith. One of a plurality of rolls 11*b* and the roll 12*b* are located between the supporting walls 18*a* and 18*b* and contacted with each other under a predetermined pressure. The roll 11*b* and the roll 12*b* are respectively formed of materials having relatively large friction coefficient. Thus, rotation of the paper ejecting roller 11 is transmitted to the transmission roller 12 by a friction force. On the other hand, on the rotary shaft 12*a*, a pinion 13 is supported adjacent the roll 12*b* for rotation with maintaining integrity.

On the support frame 16, a sliding groove 19 is formed along the ejecting direction A. On both sides of the sliding groove 19, a plurality of guide projections 24 are formed. On the support frame 16, a predetermined length of an arm member (movable member) 15 is supported slidably in the ejecting direction A by a plurality of guide projections 24. The arm member 15 is arranged at a center portion in the width direction of the ejected printing paper 27. On the front and rear ends of the arm member 15, downwardly projecting engaging projections 15*a* and 15*b* are formed respectively. In the sliding groove 19, the engaging projection 15*b* is slidably engaged. On the printing paper ejection side of the sliding groove 19, a restricting portion 20 restricting forward movement of the engaging projection 15*b* is formed. On the front end of the support frame 16, a restricting portion 21 restricting rearward movement of the engaging projection 15*a* is formed.

The arm member 15 is arranged between the paper ejection roller 11 and the ejected paper stacker 22. Movement of the engaging projections 15*b* and 15*a* are respectively restricted by the restricting portions 20 and 21. By this, the arm member 15 is movable between a first position projecting on the ejected paper stacker 22 and a second position retracted from the ejected paper stacker 22. On the other hand, on the side portion of the arm member 15, a rack 14 slightly shorter than the arm member 15 is fixed. The rack 14 is engaged with the pinion 13.

On the side of a not shown printer body, a driven roller 17 is rotatable supported. The driven roller 17 is formed with a rotary shaft 17*a* extending in parallel to the paper ejection roller 11 and a plurality of rolls 17*b* supported on the rotary shaft 17*a* for rotation with maintaining integrity therewith. On the outer peripheral surface of each roll 17*b*, a plurality of mutually parallel uneven portions are the rotary shaft 17*a*. Each roll 17*b* is contacted with each roll 11*b* under a predetermined pressure to depress the printing medium 27 transporting by rotation of the paper ejecting roller 11 toward the paper ejecting roller 11.

The support frame 16 is tilted to frontwardly ascend (downstream side) of the ejecting direction A. By this, the front end of the arm member 15 located at substantially at the same height with a nip portion clamped by the paper ejecting roller 11 and the driven roller 17 when it is projected in the largest extent.

The pinion 13 and the roll 12*b* forms a motion force transmitting means for transmitting rotation in the clockwise direction of the paper ejecting roller 11 as a force for moving the arm 15 toward the first position and transmitting rotation in the counterclockwise direction of the paper ejecting roller 11 as a force form moving the arm 15 toward the second position. The restricting portions 20 and 21 and the engaging projections 15*a* and 15*b* forms restricting means for restricting further movement of the arm member 15 when the arm member 15 reaches the first position or the second position. On the other hand, the roll 11*b* and 12*b* form lost motion means for causing idling or lost motion rotation of the paper ejecting roller 11 relative to the arm member 15 from a timing where the arm member 15 reaches the first position or the second position.

On the other hand, on the printer body, control means 23 comprising a microcomputer or so forth, is arranged. The control means 23 feeds a forward drive signal to a motor in advance of ejection of the printing paper 27 to drive the paper ejecting roller 11 in the clockwise direction in FIG. 2 to drive the arm member 15 to project at the first position. Subsequently, at a predetermined timing depending upon rotation speed of the paper ejecting roller 11 or so forth, the control means 23 feeds a reverse drive signal to cause pivotal motion of the paper ejecting roller 11 in the counterclockwise direction for retracting the arm member 15 to the second position. Thereafter, the control means 23 feeds the forward drive signal at the timing depending upon the rotation speed of the paper ejecting roller 11 or so forth to again cause rotation of the paper ejecting roller 11 in the clockwise direction without transporting the printing paper 27 to project the arm member 15 at the first position. Subsequently, at a predetermined timing, the control means 23 feeds a reverse drive signal to cause pivotal motion of the paper ejecting roller 11 in the counterclockwise direction for retracting the arm member 15 to the second position.

FIGS. 4 to 8 are side elevations of the paper ejecting mechanism 10 for explaining a sequence of paper ejecting processes. In the shown embodiment of the ink-jet printer, the printing paper 27 is printed by a printing portion (not shown) and transported in an orientation upwardly directing a printed surface. The paper ejecting roller 11 is rotated in the clockwise direction in advance of ejection of the printing paper 27. By this, the printing paper 27 transported from the printing portion is moved toward downstream side past through the nip portion between the paper ejecting roller 11 and the driven roller 17.

At this time, the transmission roller 12 is rotated in the counterclockwise direction by transmission of rotational force to the roll 12*b* from the roll 11*b*. Therefore, since the rack 14 is fed by the rotating pinion 13, the arm member 15 is pivoted to the first position where the motion of the engaging projection 15*b* is restricted by the restricting portion 20. At a timing where the motion of the arm member 15 is restricted by the restricting portion 20, further rotation of the roll 12*b* is prevented. The paper ejecting paper 11 continues rotation in the same direction with causing lost motion rotation of the roll 11*b* relative to the roll 12*b*.

Figure 4:
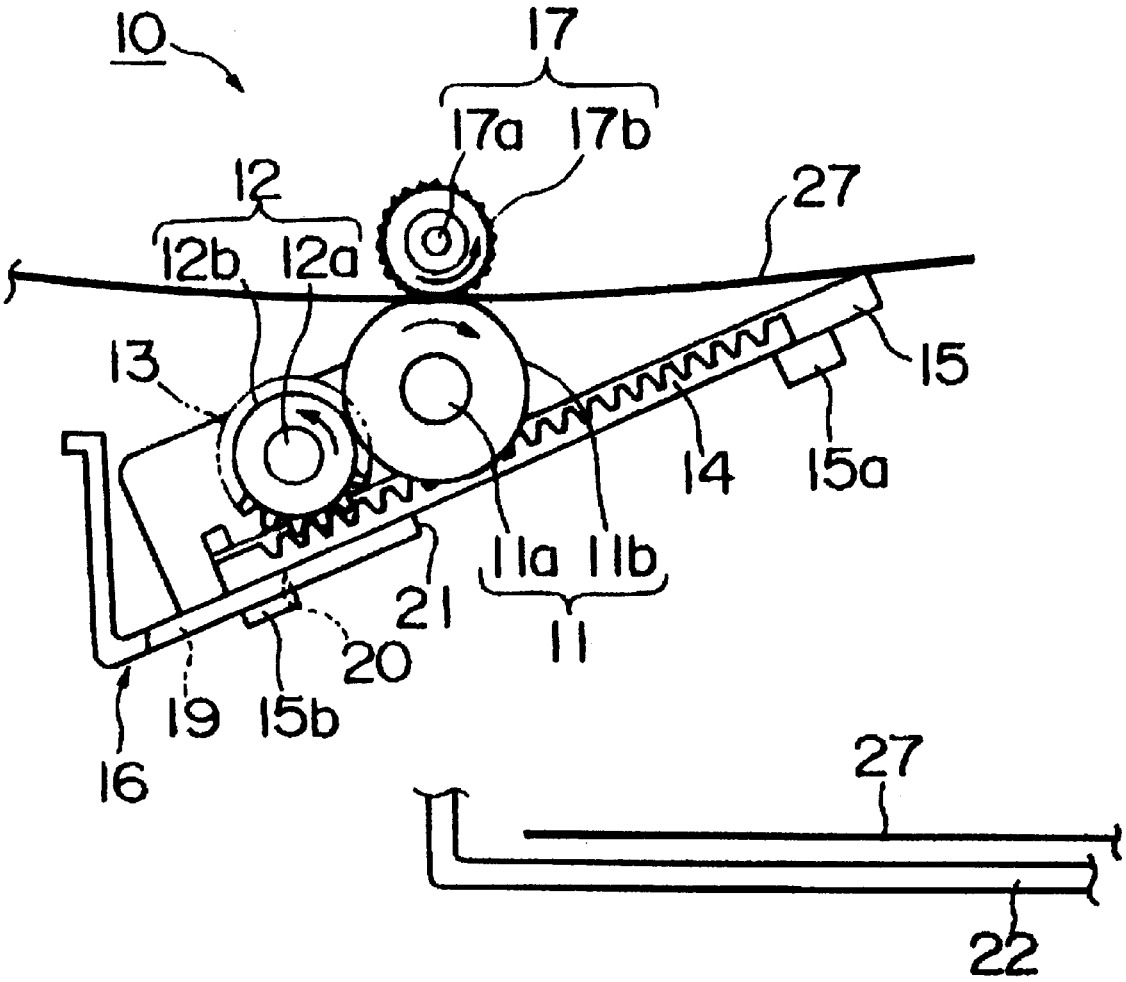
FIGS. 4 to 8 are side elevations of the paper ejecting mechanism for explaining paper ejecting process of a printing paper.
Figure 5:
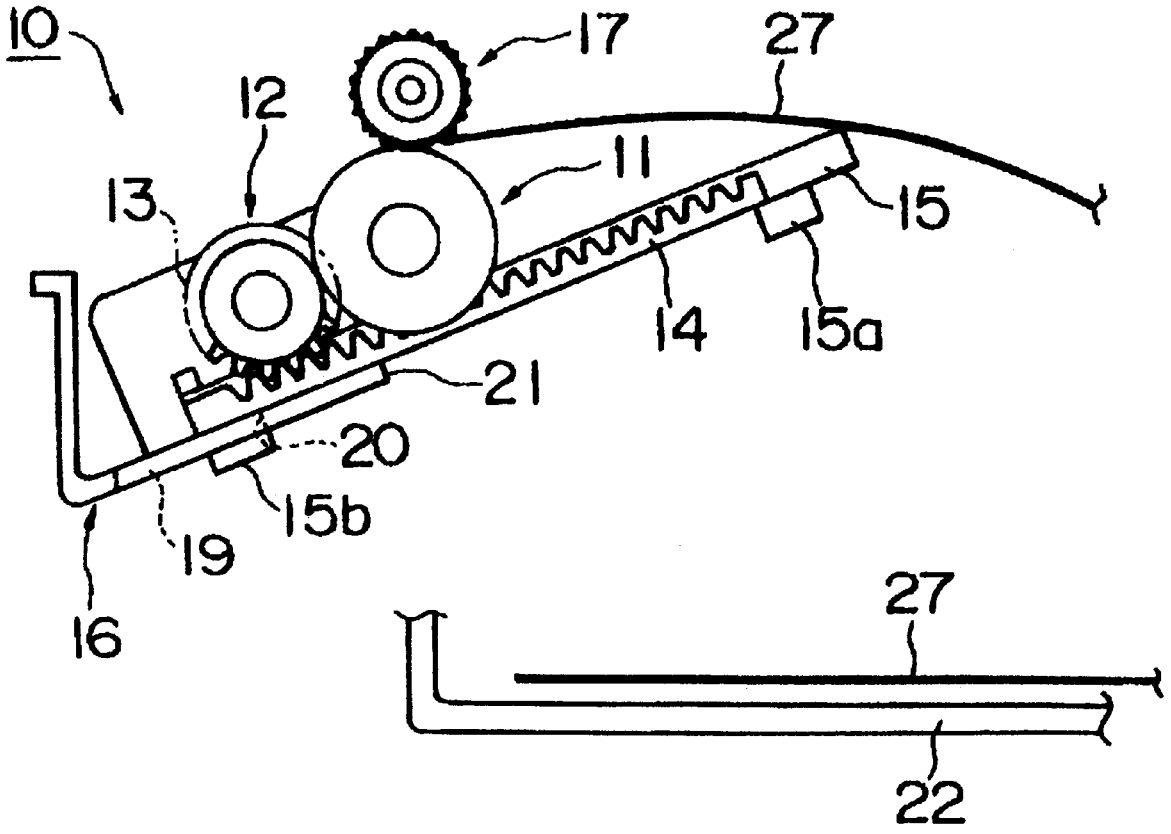
Figure 6:
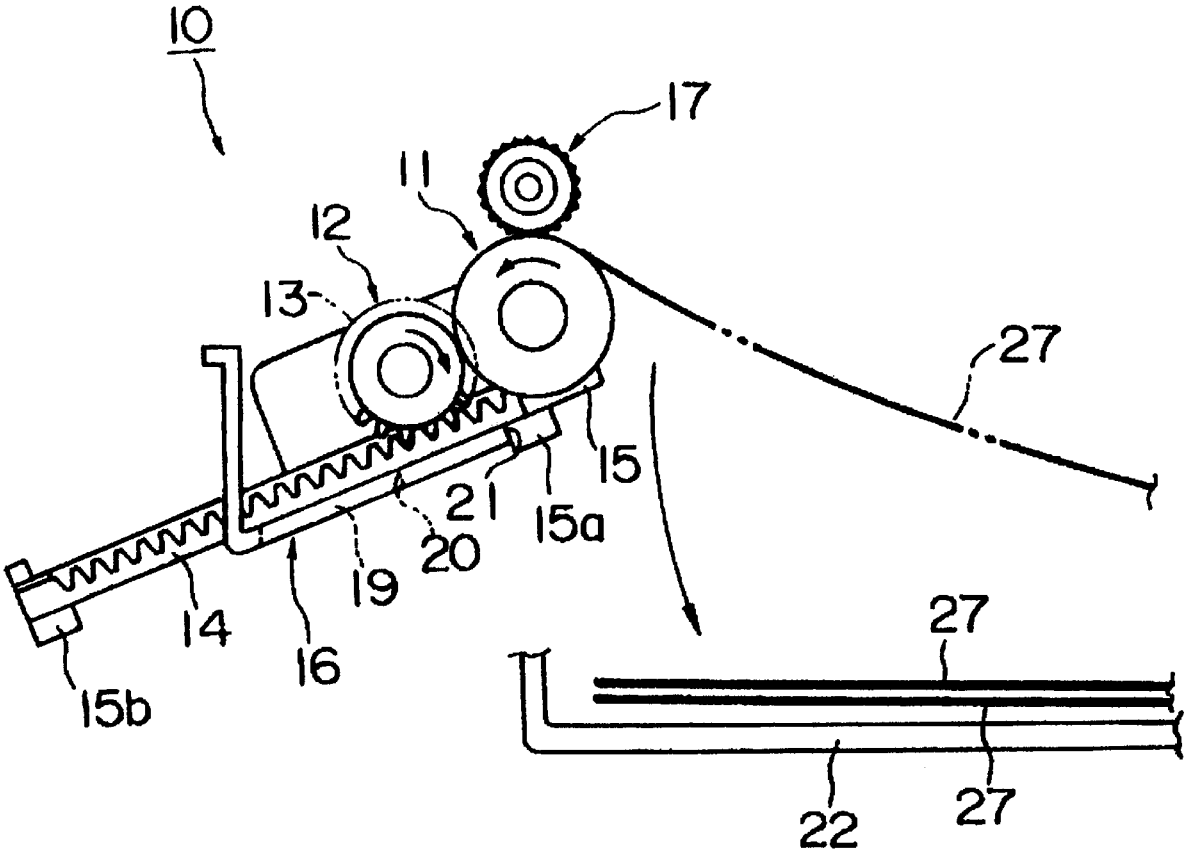

The printing paper 27 is supported the lower side by the front end of the arm member 125 and transported toward downstream side in the condition not contacting the front portion of the printing medium to the ejected paper stacker 22 (FIG. 4). The printing paper 27 is deflected frontwardly about the front end of the arm member 11 serving as a fulcrum. Then, the rear end which is flipped-up, contacts with the uneven portion of the driven roller in a condition shown in FIG. 5. During this period, the printing surface of the printing paper 27 ejected in preceding order is dried in the extent not causing stain by the ink even when the subsequent printing paper is stacked.

Next, since the reverse drive signal is fed from the control means 23 at the predetermined timing, the paper ejecting roller 11 is rotated in the counterclockwise direction. By this, the arm member 15 receives rotation of the roll 11*b* by the rack 14 to be retracted in a direction opposite to the ejecting direction A for retracting up to the second position where the engaging projection 15*a* is restricted by the restricting portion 21. At a timing where the arm member 15 is restricted by the restricting portion 21, the paper ejecting roller 11 continues rotation in the same direction in the lost motion rotation relative to the roll 12*b*. During this period, the printing paper drops down with causing deflection to be stacked on the printing paper 27 ejected at the preceding timing.

Figure 7:
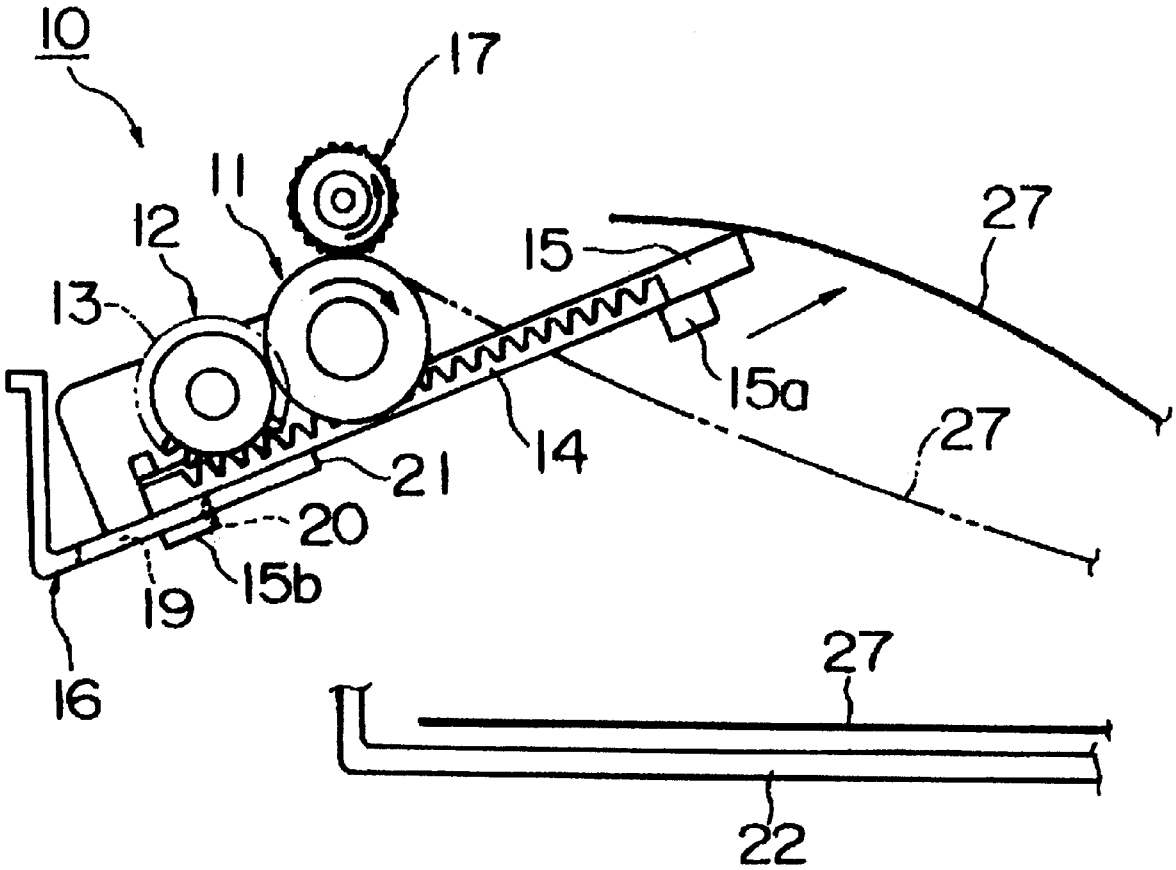
Figure 8:
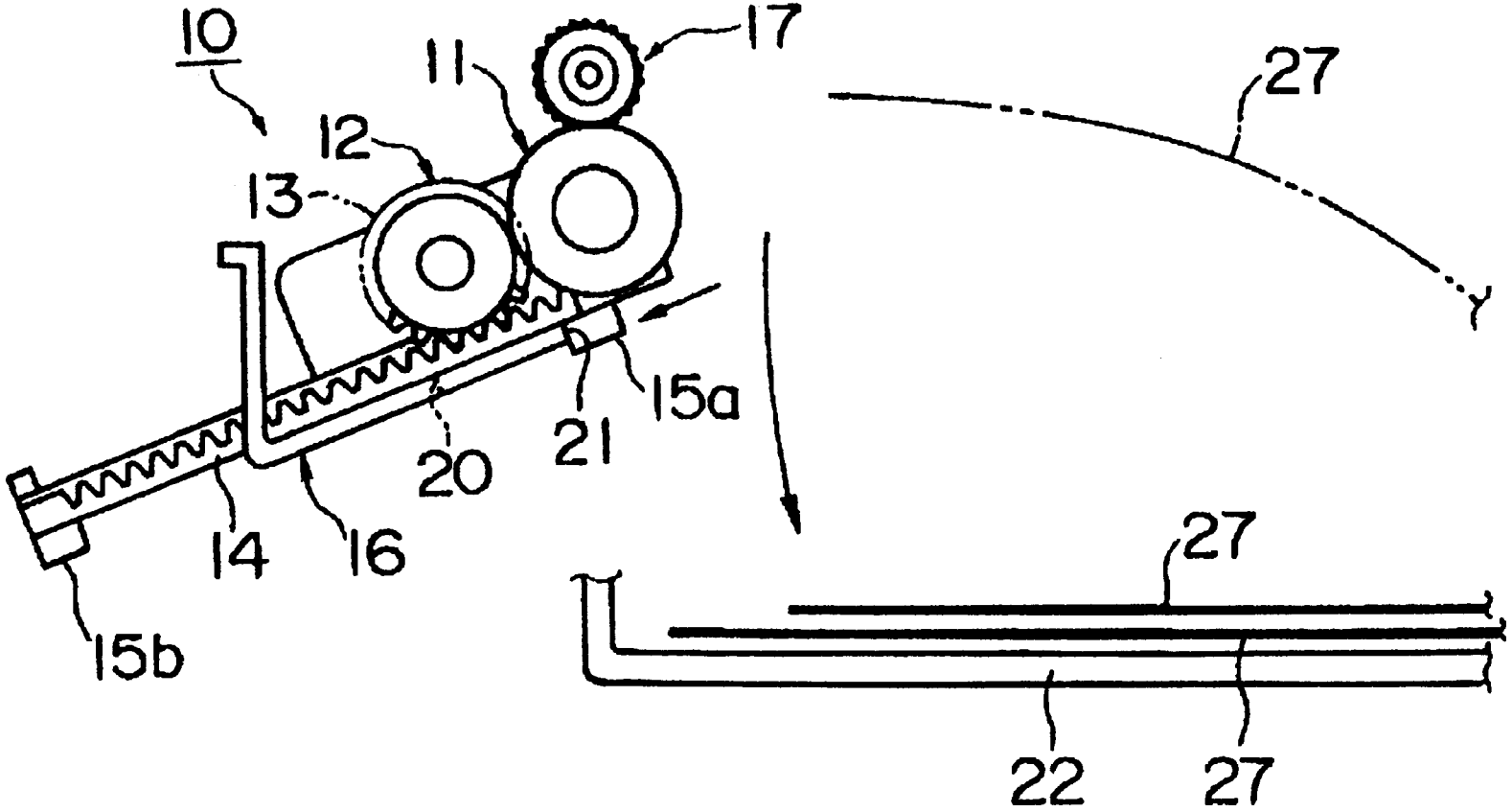
Figure 9:
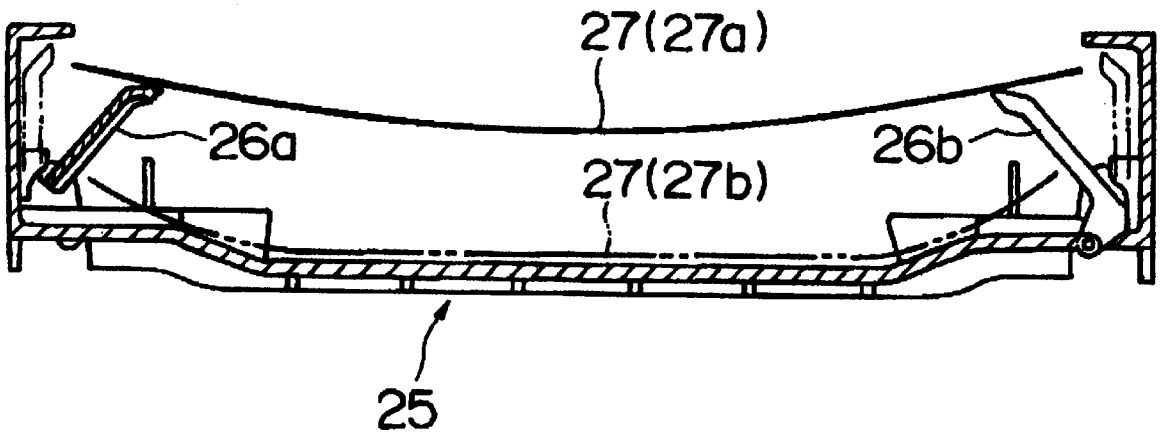
FIG. 9 PRIOR ART
FIG. 9 is a sectional front elevation showing the conventional paper ejecting mechanism of the ink-jet printer.

Next, the control means 23 feeds the forward drive signal at the predetermined timing to rotate in the clockwise direction again without feeding the printing paper 27 to project the arm member 15 toward the first position. Then, the reverse drive signal is fed at the predetermined timing for retracting the arm member 15 to the second position. Therefore, even when the printing paper 27 is in the condition where the printing paper 27 contacts with the paper ejecting roller 11 and cannot fall down, the printing paper 27 is pushed by the arm member 15 again projecting to be forcedly released from the paper ejecting roller 11 to fall down (FIGS. 7 and 8). The arm member 15 retracted to the second position in FIG. 2, is again pivoted to the first position by the paper ejecting roller 11 upon next paper ejecting operation.

In the ink-jet printer according to the present invention, since the following printing paper 27 can be stacked on the preceding printing paper after elapsing of drying period of the printed surface of the printing paper 27, stain of the sequentially ejected printing papers 27 by the ink can be prevented to improve printing quality. On the other hand, the rotational force of the paper ejecting roller 11 can be used as a force for moving the arm member 15 to separately provide a driving power source for moving the arm member to simplify the paper ejecting mechanism. Furthermore, by providing the arm member 15 in a shape supporting the center portion in the width direction of the printing paper 27 from the lower side, a function for ejection with once supporting the printing paper 27 from the lower side can be realized. Therefore, the long rail member required in the conventional paper ejecting mechanism becomes unnecessary. Accordingly, the paper ejecting mechanism can be formed compact. Associating therewith, the overall printer can be formed compact and can achieve cost down.

In the ink-jet printer according to the present invention, a timing of a paper feeding operation for dragging the printing paper 27 before printing from the not shown paper tray by a pick-up roller, for example and a timing for retracting the arm member 15 at the second time during a sequence of paper ejecting operation can be matched with each other. By this, in comparison with the case where paper feeding operation is performed after performing operation for retracting the arm member 15 at the second time, operation sequence can be simplified to shorten a period required for a sequence of process steps from paper feeding to paper ejection.

As set forth above, according to the ink-jet printing apparatus according to the present invention permits sequential ejection of printed papers without causing stain by non-dried ink, whereby improves printing quality and permits down-sizing of the paper ejecting mechanism by simplifying a construction of a paper ejecting mechanism and whereby achieves down-sizing of the overall printing apparatus.

Although the present invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

For instance, while the present invention has been discussed in terms of the preferred embodiment of the present invention, the ink-jet printing apparatus, such as for ink-jet printer and so forth, is not specified to the construction of the shown embodiment but can be modified and/or changed in various fashion from the construction shown in the shown embodiment.

What is claimed is:

1. An ink-jet printing apparatus of a type, in which sheet form printing media ejected in substantially horizontal direction are stacked on an ejected paper stacker in sequential order of ejection, comprising:

a paper ejecting roller rotatable in a first direction for ejecting said printing medium and a second direction opposite to said first direction;

movable member arranged between said paper ejecting roller and said ejected paper stacker and movable between a first position projecting above said ejected paper stacker for supporting said printing medium from a lower side thereof, and a second position retracted from the position above said ejected paper stacker and permitting falling down of said printing medium;

motion force transmitting means for transmitting rotation of said paper ejecting roller in said first direction as a motion force for moving said movable member toward said first position and transmitting rotation of said paper ejecting roller in said second direction as a motion force for retracting said movable member toward said second position; and control means for driving said paper ejecting roller in said first direction in advance of ejection of said printing medium for projecting said movable member to said first position via said motion force transmitting means and driving said paper ejecting roller in said second direction for retracting said movable member in said second direction.

2. An ink-jet printing apparatus as set forth in claim 1, which further comprises:

restricting means for restricting further movement of said movable member when said movable member is reached at said first position or said second position; and lost motion means for causing lost motion rotation of said paper ejecting roller relative to said movable member from the timing where said movable member reaches said first position or said second position.

3. An ink-jet printing apparatus as set forth in claim 1, wherein said control means projecting said movable member at said first position by again rotating said paper ejecting roller in said first direction without transporting said printing medium after once driving said paper ejecting roller in said second direction and subsequently retracting said movable member to said second position by rotating said ejecting roller in said second direction.

4. An ink-jet printing apparatus as set forth in claim 2, wherein said control means projecting said movable member at said first position by again rotating said paper ejecting roller in said first direction without transporting said printing medium after once driving said paper ejecting roller in said second direction and subsequently retracting said movable member to said second position by rotating said ejecting roller in said second direction.

5. An ink-jet printing apparatus as set forth in claim 1, wherein said movable member is constructed with an arm member having a rack slidably supported in an ejecting direction of said printing medium and extending in said ejecting direction.

6. An ink-jet printing apparatus as set forth in claim 2, wherein said movable member is constructed with an arm member having a rack slidably supported in an ejecting direction of said printing medium and extending in said ejecting direction.

7. An ink-jet printing apparatus as set forth in claim 3, wherein said movable member is constructed with an arm member having a rack slidably supported in an ejecting direction of said printing medium and extending in said ejecting direction.

8. An ink-jet printing apparatus as set forth in claim 4, wherein said movable member is constructed with an arm member having a rack slidably supported in an ejecting direction of said printing medium and extending in said ejecting direction.

9. An ink-jet printing apparatus as set forth in claim 5, wherein said motion force transmitting means comprises a pinion meshing with said rack, and a frictional driven roll contacting with a driving roll integrally fixed on a rotary shaft of said paper ejecting roller, and said lost motion means comprises said driving roll and said frictional driven roll.

10. An ink-jet printing apparatus as set forth in claim 6, wherein said motion force transmitting means comprises a pinion meshing with said rack, and a frictional driven roll contacting with a driving roll integrally fixed on a rotary shaft of said paper ejecting roller, and said lost motion means comprises said driving roll and said frictional driven roll.

11. An ink-jet printing apparatus as set forth in claim 7, wherein said motion force transmitting means comprises a pinion meshing with said rack, and a frictional driven roll contacting with a driving roll integrally fixed on a rotary shaft of said paper ejecting roller, and said lost motion means comprises said driving roll and said frictional driven roll.

12. An ink-jet printing apparatus as set forth in claim 8, wherein said motion force transmitting means comprises a pinion meshing with said rack, and a frictional driven roll contacting with a driving roll integrally fixed on a rotary shaft of said paper ejecting roller, and said lost motion means comprises said driving roll and said frictional driven roll.

* * * * *